United States Patent [19]

Yokota

[11] 4,432,632

[45] Feb. 21, 1984

[54] APPARATUS FOR HOLDING A RECORDING MEMBER IN THE FORM OF AN ENDLESS BELT IN A RECORDING SYSTEM USING THE SAME

[75] Inventor: Takashi Yokota, Tokyo, Japan

[73] Assignee: Ricoh Company, Ltd., Japan

[21] Appl. No.: 338,606

[22] Filed: Jan. 11, 1982

[30] Foreign Application Priority Data

Jan. 13, 1981 [JP] Japan ..... 56-3238[U]
Jan. 13, 1981 [JP] Japan ..... 56-3239[U]
Jan. 13, 1981 [JP] Japan ..... 56-3240[U]

[51] Int. Cl.[3] ..... G03G 15/06

[52] U.S. Cl. ..... 355/3 DD; 355/3 R; 355/3 BE

[58] Field of Search ..... 355/3 R, 3 BE, 3 DR, 355/8, 11, 3 DD

[56] References Cited

U.S. PATENT DOCUMENTS 3,689,146 9/1972 Ito et al. ..... 355/11
3,985,436 10/1976 Tanaka et al. ..... 355/3 DD
4,025,180 5/1977 Kurita et al. ..... 355/3 R
4,286,861 9/1981 Matsumoto et al. ..... 355/3 DD

*Primary Examiner*—Richard L. Moses
*Attorney, Agent, or Firm*—Guy W. Shoup; Gerard F. Dunne

[57] ABSTRACT

A developing unit is adapted to be inserted into or withdrawn from a recording system and carries on a recording unit including a recording member in the form of an endless belt. A pair of rollers which support and drive the recording member as well as a developing sleeve which is utilized for converting a latent image formed on the record into a visual image are substantially aligned with each other in a direction which is parallel to the direction in which the developing unit is inserted or withdrawn. A transmission member is disposed at a location offset substantially perpendicular to such direction and transmits power from the recording system to one of the drive rollers which support the record. The power transmission takes place from the transmission member to the drive roller and then to the developing sleeve.

14 Claims, 7 Drawing Figures

APPARATUS FOR HOLDING A RECORDING MEMBER IN THE FORM OF AN ENDLESS BELT IN A RECORDING SYSTEM USING THE SAME

BACKGROUND OF THE INVENTION

This invention relates to an apparatus for holding a recording member in the form of an endless belt in proper position within a recording system, and also to a recording system using the same.

A recording member in the form of an endless belt of a photocopy machine or the like generally has a degree of flexibility, and extends around a plurality of rollers which support and drive it. The recording member may become worn and degraded after repeated use, and must be periodically replaced by a fresh one. A conventional practice in replaceing a belt-shaped recording member of a copying machine or other recording system has been to open the side of the recording system so that only the belt-shaped recording can be withdrawn from rollers which are often mounted in a fixed position in the system. Such practice simplifies any adjustment in position that must be made once the fresh recording member is installed since the positional relationship of the recording member with other members and devices disposed within the recording system remains invariable. However, the tension applied to the belt-shaped recording member must be released, and the surface or surfaces which are used to support the recording member must be adjusted for accuracy, resulting in a complex mechanism and operations. In addition, when a fresh recording member is run around the rollers to install it, the surface of the record may be damaged. Another approach has been to open the top of the recording system so that the recording member extending around the rollers can be lifted together with the rollers for removal. However, with such an approach a mechanism is needed to open the top of the system, and such mechanisms are often complex. Further, it is often necessary to readjust the positional relationship between the recording member and other members and devices within the recording system. Additionally, a complex arrangement is required to support the rollers movably within the system.

SUMMARY OF THE INVENTION

In accordance with the invention, there is provided an apparatus for holding a recording member in the form of an endless belt comprising a recording unit including a recording member in the form of an endless belt, a plurality of rollers for supporting and driving the recording member and support plates which support the opposite ends of the rollers. A developing unit has portions serving to carry the recording unit, and the developing unit includes a developing sleeve for supplying a developer to convert a latent image formed on the surface of the recording member into a visual image. The developing unit may further include an integral vessel containing a supply of developer and the developing sleeve therein and means for positioning one of the rollers of the recording member located adjacent to the developing sleeve with respect to the developing unit in order to maintain a desired gap between the developing sleeve and the recording member. An abutment against which the record unit can bear is also provided; and guide means for guiding the developing unit for insertion into or removal from a recording system, positioning means for positioning the developing unit with respect to the recording system; and another positioning means for positioning the recording unit on the developing unit with respect to the recording system are provided.

At least two of the rollers of the recording unit as well as the developing sleeve of the developing unit are substantially aligned with each other in a direction which is parallel to the direction in which the developing and recording unit can be inserted or withdrawn from the recording system. A transmission member transmits power from the recording system to one of drive rollers which support the recording member, and is disposed at a location offset substantially perpendicularly to such direction. Power transmission takes place from the transmission member to the drive roller and thence to the developing sleeve.

Accordingly, it is an object of the invention to provide an apparatus for holding a recording member in the form of an endless belt which facilitates the loading or removal of the recording member onto or from a recording system.

It is another object of the invention to provide such holding apparatus which permits a positional accuracy to be reliably achieved without requiring any positional adjustment between the recording member and other members or devices disposed within the recording system.

It is a further object of the invention to provide such a holding apparatus which is compact in size and simple in construction and capable of positively driving the recording member in the form of the endless belt.

It is still another object of the invention to provide a recording system which uses the described holding apparatus.

Above and other objects and features of the invention will become apparent from the following description with reference to the drawings.

DESCRIPTION OF PREFERRED EMBODIMENT

Figure 1:
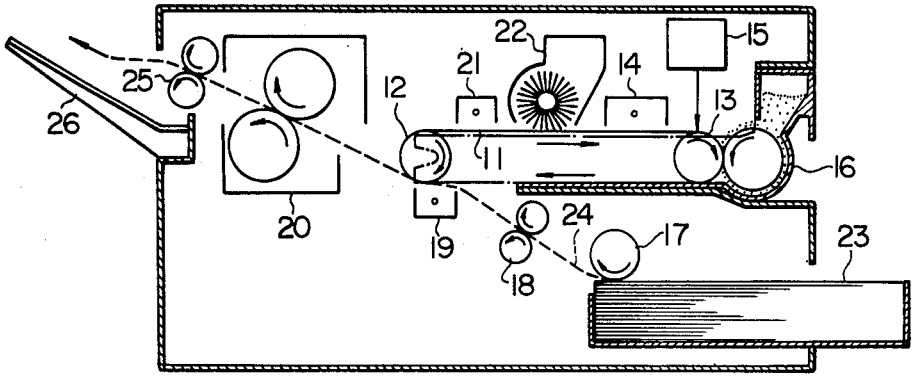
FIG. 1 is a schematic view of one form of recording system in which the invention is incorporated.

Referring to FIG. 1, there is shown one form of recording system in which the invention is incorporated. A recording member 11 in the form of an endless belt is formed by a photosensitive member for electrophotography which comprises an inorganic or organic photoconductor on a base film. The recording member 11 extends around a pair of rollers 12, 13. The roller 12 is a follower roller while the roller 13 is a drive roller. A variety of devices are disposed around the path of the belt 11. As viewed in the clockwise direction of rotation of the photosensitive belt 11, these devices include a charger 14, an exposure unit 15, a developing unit 16, a feed roller 17, registering rollers 18, a transfer charger 19, a fixing unit 20, a neutralizing charger 21 and a cleaning unit 22.

Describing the operation of the system, the surface of the photosensitive belt 11 is initially charged uniformly to a given polarity by means of the charger 14, and is then irradiated with light containing information representing an image to be recorded which is projected by the exposure unit 15. As a consequence, the charge on the photosensitive belt 11 is selectively dissipated, forming an electrostatic latent image in accordance with an image to be recorded. The developing unit 16 then supplies colored, fine particles, commonly referred to as toner, to convert the latent image into a visual image or a toner image. A cassette 23 contains a supply of record sheets 24, which are fed one by one to the transfer charger 19 in timed relationship with the formation of the image on the photosensitive belt 11, by means of the feed roller 17 and the registering rollers 18. The transfer sheet is brought into overlapping relationship with the toner image, whereupon the record sheet is subject to a charging action by the transfer charger 19 to have the toner image transferred thereto. Subsequently, the record sheet 24 is separated from the belt 11 and fed into the fixing unit 20 where the transferred toner image is fixed for subsequent delivery by delivery rollers 25 onto a tray 26. On the other hand, any remaining potential on the surface of the belt 11 is removed or extinguished by the neutralizing charger 21 and any residual toner is cleaned off by the cleaning unit 22.

Figure 2:
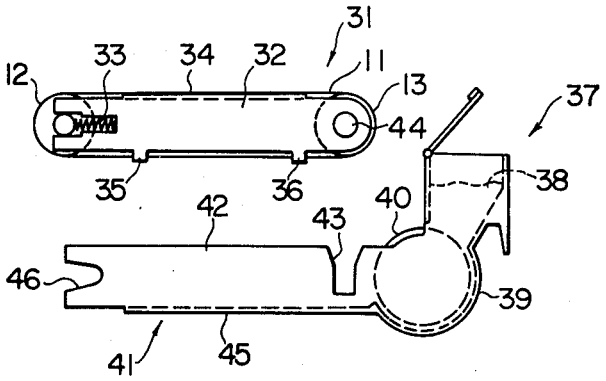
FIG. 2 is a schematic exploded, front view of a unit for a photosensitive member unit and a developing unit according to one embodiment of the invention.

It is a feature of the invention that both the unit for the photosensitive belt 11 and the developing unit 16 are each constructed as a separate unit which can be joined together to form an integral assembly. Specifically, referring to FIG. 2, a recording unit 31 for the recording or photosensitive member includes the photosensitive belt 11, the rollers 12, 13 which support and drive the belt, and support plates 32 formed on respective sides of the unit and which rotatably carry the opposite ends of the rollers. The roller 12 is urged outwardly by a spring 33 which is mounted in the support plate 32, thus maintaining the belt 11 taut. The support plates 32 have a top plate 34 extending therebetween to define a bearing surface for the upper run of the belt 11. The bottom of the support plates 32 are each formed with a pair of spaced projections 35, 36 which extend below the lower surface of the lower run of the belt 11. A developing unit 37 includes a vessel 39 with a lid and containing a supply of developing toner 38, and a developing sleeve 40 which is rotatably supported in the bottom of the vessel 39. Each of the side plates and the bottom plate of the vessel 39 are extended laterally from the region adjacent the developing sleeve 40 to define a receiving portion 41 for carrying the photosensitive member unit 31. Adjacent to the developing sleeve 40, both of the side plates 42 of the receiving portion 41 are formed with grooves 43 which are elongate in a direction perpendicular to the length of the receiving portion and which receive respective end portions of a shaft 44 therein on which the belt drive roller 13 is mounted. In this manner, the belt 11 is positioned relative to the developing sleeve 40. The recording or photosensitive member unit 31 may simply be placed over the bottom plate 45 of the receiving portion 41 of the developing unit 37, with the roller shaft 44 merely being engaged in the grooves 43. Thus, while the unit 31 is constrained from lateral movement within the receiving portion, it is free to move in an upward direction. When the unit 31 is placed over the bottom plate 45 of the receiving portion 41, only the projections 35, 36 extending from the support plate 32 of the unit 31 bear against the bottom plate 45, thus avoiding any likelihood that the belt 11 may be damaged. The free end of the receiving portion 41 is formed with a groove 46 extending lengthwise thereo which is utilized to position the integrated assembly of the developing unit 37 and recording unit 31 when it is mounted on the recording system.

Figure 3:
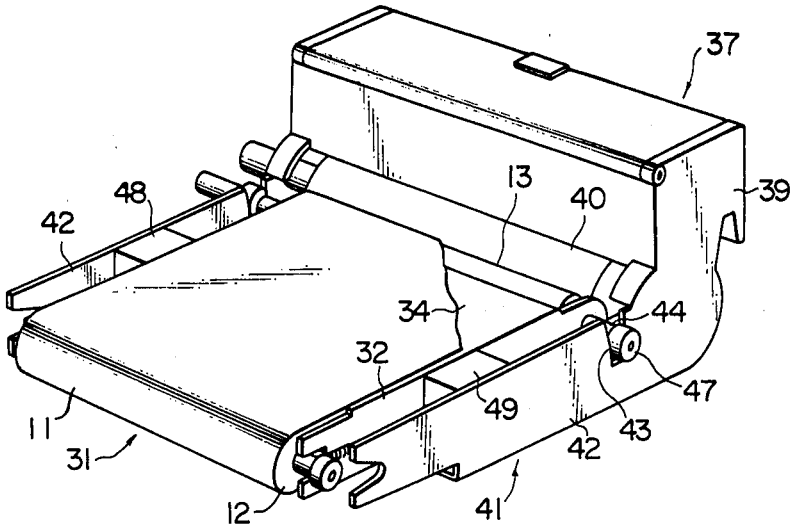
FIG. 3 is a perspective view, illustrating an assembled condition of the photosensitive member unit and the developing unit shown in FIG. 2.

FIG. 3 shows the photosensitive member unit 31 assembled with the developing unit 37. In FIG. 3, a bearing 47 mounted on the free end of the rotary shaft 44 associated with the drive roller 13 fits in the groove 43 formed in the receiving portion of the developing unit 37. The use of such bearing is known in the art, and is applicable to other locations. It will be evident from FIG. 3 that a pair of spacers 48, 49 are interposed between the support plates 32 of the photosensitive member unit 31 and the associated side plates 42 of the abutment receiving portion 41 of the developing unit 37. In this way, the belt 11 is accurately positioned in its lateral direction relative to the developing unit 37.

Figure 4:
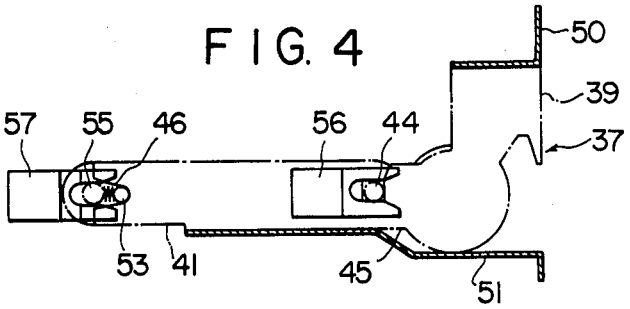
FIG. 4 is a schematic side view illustrating the photosensitive member unit and developing unit received in a recording system adapted to be used with one embodiment of the invention.
Figure 5:
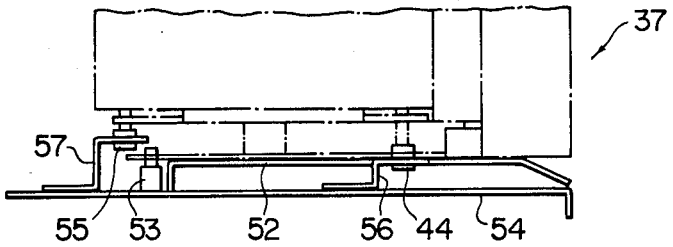
FIG. 5 is a schematic fragmentary plan view illustrating the photosensitive member unit and developing unit received in the recording system adapted to be used with one embodiment of the invention.

The developing unit 37 carrying the photosensitive member unit 31 thereon in the manner mentioned above can be inserted into or withdrawn from a recording system. Specifically, FIG. 4 shows part of the recording system including a pair of guide plates 50, 51. As shown, the guide plate 50 guides the top of the vessel 39 while the guide plate 51 guides the bottom plate 45 of the developing unit 37. Thus, the developing unit 37 can be inserted into the recording system along a path defined by these guide plates. As shown in FIG. 5, the recording system is also provided with respective guide plates 52 which guide each lateral side of the developing unit 37, thus positioning the developing unit 37 with respect to the recording system as viewed in the lateral direction of the photosensitive belt. The recording system is also provided with a pin 53 projecting from a side plate 54 of the system which is adapted to engage the groove 46 formed in the free end of the developing unit as it is inserted in the recording system from the right, as shown in FIG. 1. The pin 53 serves to accurately position the integrated assembly in the longitudinal direction of the belt 11. A pair of spaced brackets 56, 57 are secured to the side plate 54 of the system and include respective grooves for receiving the rotary shaft 44 associated with the drive roller 13 and the rotary shaft 55 associated with the follower roller 12 as the integrated assembly is inserted into the system. The purpose of these brackets is to provide support and positioning of the belt 11 in the vertical direction, acting through the respective rollers. It will be seen that the rollers 12, 13 and the developing sleeve 40 are substantially aligned with each other in a direction which is parallel to the direction in which the developing unit is inserted.

It will be seen from the foregoing description that the integrated assembly of the recording unit 31 and developing unit 37 of the invention is provided with various positioning means as mentioned above, so that the insertion of the integrated assembly into the recording system to a given location is all that is required to achieve a desired positional relationship with other members and devices within the recording system in a positive and easily facilitated manner. By withdrawing the integrated assembly out of the recording system as required, replenishment of toner to the developer vessel 39 or replacement of the photosensitive belt 11 are greatly facilitated.

Figure 6:
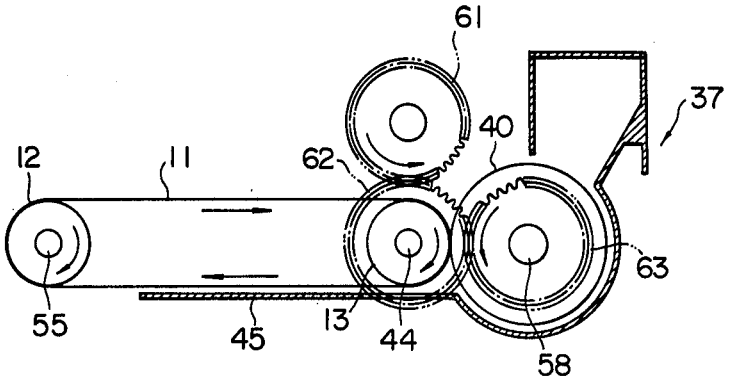
FIG. 6 is a schematic side view of a drive system according to one embodiment of the invention.
Figure 7:
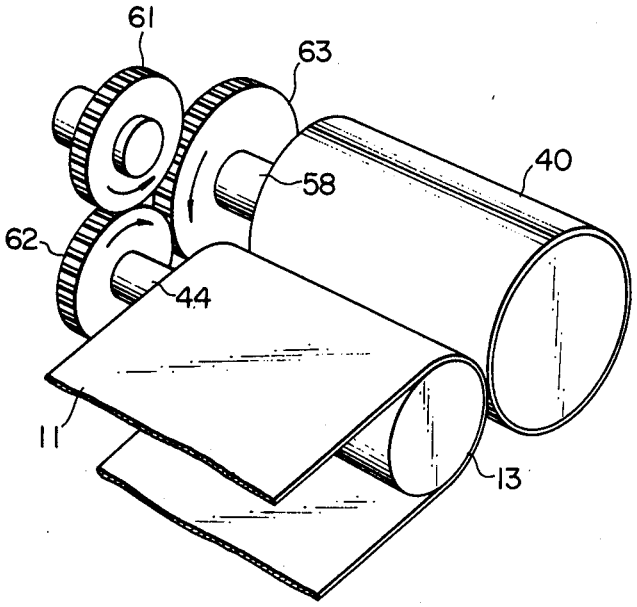
FIG. 7 is a schematic perspective view of the drive system according to one embodiment of the invention.

FIG. 6 shows a drive system which is used with the invention. As mentioned previously, the rollers 12, 13 which support and drive the belt 11 as well as the developing sleeve 40 are substantially aligned with each other in a direction which is parallel to the direction in which the developing unit 37 is inserted or withdrawn. A power transmission gear 61 is connected to a drive source of the recording system and is disposed at a location which is offset in a direction perpendicular to such direction. The gear 61 meshes with a drive gear 62 which is fixedly mounted on the rotary shaft associated with the drive roller 13. In the arrangement shown, the gear 61 meshes with the drive gear 62 at the top portion thereof, but the gear 61 may mesh with the drive gear 62 at the power portion thereof. The drive gear 62 also meshes with a follower gear 63 which is fixedly mounted on a rotary shaft 58 on which the developing sleeve 40 is mounted. Accordingly, the power from the drive source is transmitted through the gear 61 to the gears 62 and 63. Such construction is illustrated in perspective view in FIG. 7. This construction of the drive system facilitates the insertion or withdrawal of the developing unit 37 while assuring a positive power transmission when the unit is inserted. It will be understood that the power transmission from the drive system may utilize friction wheels rather than gears.

As discussed above, according to the invention, both the recording unit and the developing unit are constructed as an integral assembly, so that there is provided an apparatus for holding a recording member in the form of an endless belt which facilities the mounting or withdrawal of these units onto or from a recording system while assuring a positive position control. It will be seen that the clearance or gap between the recording member on one hand and the developing sleeve or the individual chargers on the other must be maintained very closely. However, with the present invention, a variety of positioning means facilitate the positioning of the recording unit and the developing unit relative each other and other components of the system to achieve relative positioning to a high accuracy even though these units are detachable from the recording system, thus dispensing with a positional adjustment and avoiding any likelihood that the mounting location may vary from time to time. In addition, a large opening in the recording system as provided in the prior art arrangement is unnecessary, but the provision of a small opening and simple guide means is all that is required to enable a replacement of a recording member, repair of parts and a replenishment of a developer. An integral construction of each of the recording unit and the developing unit simplifies the construction and reduces the size, contributing to the ease with which the entire recording unit is replaced while avoiding any likelihood that the surface of the recording member may be damaged or marred by the developer during the replacement. Since the drive system is arranged to facilitate the mounting or withdrawal of the units and to assure a positive power transmission, no undue stresses are produced when inserting or withdrawing the units.

While the invention has been shown and described above in connection with the particular embodiment thereof, it should be understood that the invention is equally applicable to an electrostatic or a magnetic recording system and therefore that all these modifications, changes and alterations are covered within the scope of the invention which is defined by the appended claims.

What is claimed is:

1. An apparatus for holding a recording member in the form of an endless belt in position in a recording system, comprising a recording unit including a recording member in the form of an endless belt, a plurality of rollers for supporting and driving the recording member, and support plates for supporting the opposite ends of the rollers;

a developing unit including means for carrying the recording unit, the developing unit including a developing sleeve for supplying a developer to a latent image formed on the surface of the recording member to convert said latent image into a visual image, a vessel for receiving a supply of developer and the developing sleeve, means for positioning one of the rollers of said recording unit located adjacent to the developing sleeve with respect to the developing unit in order to maintain a predetermined gap between the developing sleeve and the recording member, and a receiving portion carrying the recording unit;

guide means for guiding the developing unit during its insertion or withdrawl into or from the recording system;

positioning means for positioning the developing unit with respect to the recording system; and another positioning means for positioning the recording unit with respect to the recording system.

2. An apparatus according to claim 1 in which at least two of the rollers of the record unit as well as the developing sleeve of the developing unit are arranged in substantial alignment with each other in a direction which is parallel to the direction in which the developing unit is inserted or withdrawn.

3. An apparatus according to claim 2, further including a transmission member for transmitting power from the recording system to one of the rollers supporting the record and which acts as a drive roller, the transmission member being disposed at a location which is offset in a direction substantially perpendicular to said direction.

4. An apparatus according to claim 3 in which the power transmission from the recording system takes place from the transmission member to the drive roller and thence to the developing sleeve.

5. A recording system including means for forming an electrostatic latent image on a recording member in the form of an endless belt carried by an apparatus for holding the recording member, means for developing the latent image with a developer, means for transferring the developed image onto a transfer member, means for neutralizing the recording member, means for removing any residual developer from the surface of the recording member;

the apparatus for holding the recording member comprising a recording unit including a recording member in the form of an endless belt, a plurality of rollers for supporting and driving the recording member and support plates for supporting the opposite ends of the rollers;

a developing unit including means for carrying the recording unit, the developing unit including a developing sleeve for supplying a developer to a latent image formed on the surface of the recording member to convert said latent image into a visual image, a vessel for receiving a supply of developer and the developing sleeve, means for positioning one of the rollers of said recording unit located adjacent to the developing sleeve with respect to the developing unit in order to maintain a predetermined gap between the developing sleeve and the recording member, and a receiving portion carrying the recording unit;

guide means for guiding the developing unit during its insertion or withdrawl into or from the recording system;

positioning means for positioning the developing unit with respect to the recording system; and another positioning means for positioning the recording unit on the developed unit with respect to the recording system.

6. A recording system according to claim 5 in which at least two of the rollers of the record unit as well as the developing sleeve are disposed in substantial alignment with each other in a direction which is parallel to the direction in which the developing unit is inserted and withdrawn.

7. A recording system according to claim 6, further including a transmission member for transmitting power from the recording system to one of the rollers supporting the record and which acts as a drive roller, the transmission member being disposed at a location which is offset in a direction substantially perpendicular to said direction.

8. A recording system according to claim 7 in which the power transmission from the recording system takes place from the transmission member to the drive roller and thence to the developing sleeve.

9. An integrated assembly of a recording unit including a recording member in the form of an endless belt trained around a plurality of rollers for forming a latent image and a developing unit including a rotatable sleeve for bringing developer to a latent image formed on said recording member to render the latent image visible, said developing unit having integral means including a receiving portion extending outwardly from said sleeve for receiving said recording unit and holding the recording member with a predetermined spacing from said sleeve.

10. An integrated assembly according to claim 9, said receiving portion having opposing side walls adapted to receive said recording unit therebetween, and a bottom wall serving to support said recording unit, each of said side walls having slots adjacent said sleeve, one of said rollers of said recording unit having end portions extending laterally outwards and adapted to fit within respective ones of said slots to form means precisely positioning the recording member relative said sleeve.

11. An integrated assembly according to claim 10, said recording unit including opposing side plates receiving end portions of said rollers, the lower portions of said side plates having spaced projections extending inwardly and adapted to underlie said recording member to provide supports engaging said bottom wall to seat said recording unit within said receiving portion with said recording member spaced from said bottom wall.

12. An integrated assembly according to claim 9, said recording unit including opposing side plates receiving end portions of said roller, the end portions of one of said rollers being received slidably within slots formed in said side plates and urged resiliently away from the other rollers to tense said recording member.

13. An integrated assembly according to claim 9, further including a recording system having means including guides for receiving said integrated assembly and permitting it as a unit to be withdrawn from said system, and a transmission member for transmitting power from the recording system to one of the rollers of said recording unit, the transmission member being disposed at a location away from the path of movement of said integrated assembly during its withdrawal from said system and adapted to engage a driving member of said integrated assembly when it is fully inserted in said system.

14. An integrated assembly assembly according to claim 13, said transmission member being a drive gear adapted to mesh with a driven gear fixed to one of said rollers of said recording unit when said integrated assembly is inserted fully within said system, and said sleeve being connected to a gear meshing with said driven gear.

* * * * *